United States Patent [19]

Schillinger

[11] Patent Number: 4,653,979

[45] Date of Patent: Mar. 31, 1987

[54] ARRANGEMENT FOR FEEDING FUEL FROM SUPPLY TANK TO INTERNAL COMBUSTION ENGINE OF POWER VEHICLE

[75] Inventor: Rainer Schillinger, Stuttgart, Fed. Rep. of Germany

[73] Assignee: Robert Bosch GmbH, Stuttgart, Fed. Rep. of Germany

[21] Appl. No.: 807,434

[22] Filed: Dec. 9, 1985

[30] Foreign Application Priority Data

Mar. 15, 1985 [DE] Fed. Rep. of Germany ..... 3509374

[51] Int. Cl.[4] ..... F04D 5/00

[52] U.S. Cl. ..... 415/53 T; 415/213 T; 415/168

[58] Field of Search ..... 415/52, 53 R, 53 T, 415/143, 144, 145, 168, 213 T, 83, 84

[56] References Cited

U.S. PATENT DOCUMENTS

| | | | |
|---|---|---|---|
| 2,696,789 | 12/1954 | Fabig | 415/53 T |
| 3,836,291 | 9/1974 | Bottcher et al. | 415/53 T |
| 3,881,839 | 5/1975 | MacManus | 415/53 T |
| 4,538,958 | 9/1985 | Takei | 415/53 T |
| 4,556,363 | 12/1985 | Watanabe et al. | 415/53 T |
| 4,566,866 | 1/1986 | Kemmner | 415/53 T |

FOREIGN PATENT DOCUMENTS

| | | | |
|---|---|---|---|
| 121552 | 4/1948 | Belgium | 415/145 |

*Primary Examiner*—Robert E. Garrett
*Assistant Examiner*—John Kwon
*Attorney, Agent, or Firm*—Michael J. Striker

[57] ABSTRACT

An arrangement for feeding fuel to an internal combustion engine of a power vehicle, comprises a supply tank, a feeding pump having a pump chamber, a rotor rotatable in the pump chamber, a suction side connected with the supply tank, a pressure side connectable with the internal combustion engine, the rotor having two end sides and being provided on at least one of the end sides with a rim-shaped feeding member having a first feeding member rim and a second feeding member rim which are arranged so that the first feeding member rim is surrounded by the second feeding member rim, a wall of the chamber which is adjacent to the feeding member, the wall being provided with two substantially ring-shaped side passages which are located opposite to the feeding member rims and open toward the latter, a suction opening and a pressure opening, one of the side passages being an inner side passage and connected with the suction opening, while the other of the side passages being an outer side passage and being connected with the pressure opening, the inner side passage having an end portion located behind the suction opening, the outer side passage having a partial region located before the pressure opening as considered in a flow direction, an intermediate passage in which the end portion of the inner side passage merges and which merges into the partial region of the outer side passage, the chamber wall including a member, the member in the region of the intermediate channel being provided with a throughgoing opening.

7 Claims, 7 Drawing Figures

ARRANGEMENT FOR FEEDING FUEL FROM SUPPLY TANK TO INTERNAL COMBUSTION ENGINE OF POWER VEHICLE

BACKGROUND OF THE INVENTION

The present invention relates to an arrangement for feeding fuel from a supply tank to an internal combustion engine of a power vehicle.

Fuel arrangements of the above-mentioned general type are known in the art. One of such arrangements is disclosed, for example, in U.S. Pat. No. 3,560,104. In this arrangement the chamber wall is not penetrated either in the side passages or in intermediate passages. Particularly during supplying of heated fuels (hot gasoline) problems can take place in the suction region of the pump, and particularly because of reducing pressure of the liquid at this location. This leads to vapor bubble generation (cavitation) which in extreme situation can lead to conditions in which the pump does not aspirate a sufficient quantity of fuel or is not completely emptied. The danger for the power vehicle in these situations is directly apparent.

U.S. Pat. No. 3,881,839 discloses a one-stage side channel pump in which for solving the above-described problem two passages are formed in the chamber wall. One of these passages is arranged opposite to the suction opening, while the other passage lies behind the suction opening as considered in the flow direction of the medium and before the first-mentioned opening. Since both ventillation openings are located in the region where a relatively high dynamic pressure takes place, complete ventillation is not guaranteed despite the provision of two ventillating openings. Also, these two openings lead to high leakage losses.

SUMMARY OF THE INVENTION

Accordingly, it is an object of the present invention to provide an arrangement for supplying fuel from a supply tank to an internal combustion engine of a power vehicle, which avoids the disadvantages of the prior art.

In keeping with these objects and with others which will become apparent hereinafter, one feature of the present invention resides, briefly stated, in an arrangement for supplying fuel from a supply tank to an internal combustion of a power vehicle in which in the region of the intermediate passage, a structural part of the feed pump which forms the chamber wall is provided with a through opening.

Because of the arrangement of only one through opening for ventillation of the pump in the region of the intermediate passage, a reliable ventillation of the pump or a sufficient degasing of the flow medium is obtained.

It has been shown that in the region of the intermediate passage the dynamic pressure of the flow medium lowers and thereby its degasing is improved, for which purpose only one throughgoing opening is required.

For the present invention it is of no importance how the displacing members of individual pump stages are formed. The arrangement in design of the displacing members can be made such as disclosed for exaple in U.S. Pat. Nos. 3,259,072, 3,315,607, 3,495,537, 3,560,104, 3,881,839 or the German Pat. No. 1,021,641.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
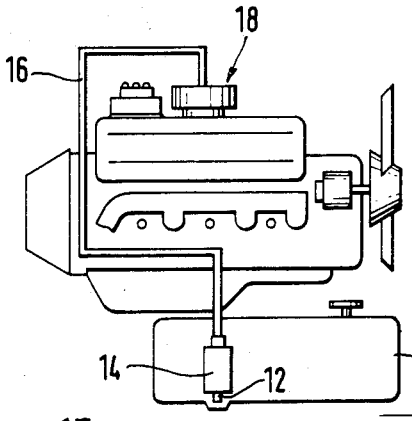
FIG. 1 is a view schematically showing an arrangement for feeding fuel, associated with a power vehicle.

FIG. 1 shows a fuel tank 10 with a fuel feeding aggregate 14 arranged therein and having a suction pipe 12 which opens into the fuel supply tank. A pressure conduit 16 is connected with the pressure side of the fuel feeding aggregate and leads to an internal combustion engine 18. During the operation of the internal combustion engine the fuel feeding aggregate 14 feeds fuel from the supply tank 10 to the internal combustion engine 18.

Figure 2:
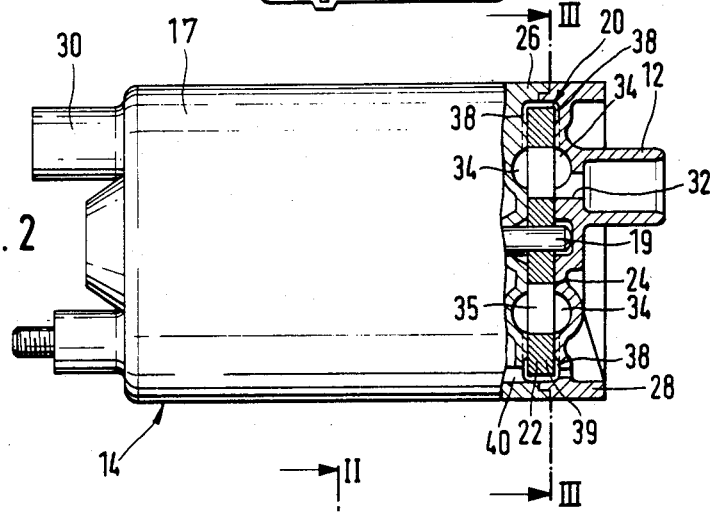
FIG. 2 is a view showing a partial section of the feeding pump of the arrangement associated with fuel feeding aggregate, on an enlarged scale, in section taken along the line II—II in FIG. 3.

FIG. 2 shows the fuel feeding aggregate 14. It has a housing 17 which is cup-shaped and surrounds a not shown electrical drive motor. The drive motor has an armature shaft 19 which carries a pump rotor 22 of a feeding pump 20. The pump rotor 22 rotates in a pump chamber 24 which is enclosed by an intermediate wall 26 associated with the housing 17 and by a member 28 which forms the housing cover. The member 28 has a suction pipe 12. The housing 17 has a pipe 30 which encloses a pressure opening connected with the pressure conduit 16 of FIG. 1. The feeding pump 20 which includes the rotor 22 and the pump chamber 24 aspirates the flow medium via a suction opening 32 in the cover 28 and supplies the same into an inner ring-shaped or side passage 34 (compare FIGS. 2 and 3) in direction of the arrow 36 into an outer or side passage 38 and into an outer side passage to a pressure opening 40 in the intermediate wall 26 where it reaches the housing 17. There it flows around the parts which belong to the drive motor and enters via the pressure pipe 30 into the pressure conduit 16.

Figure 3:
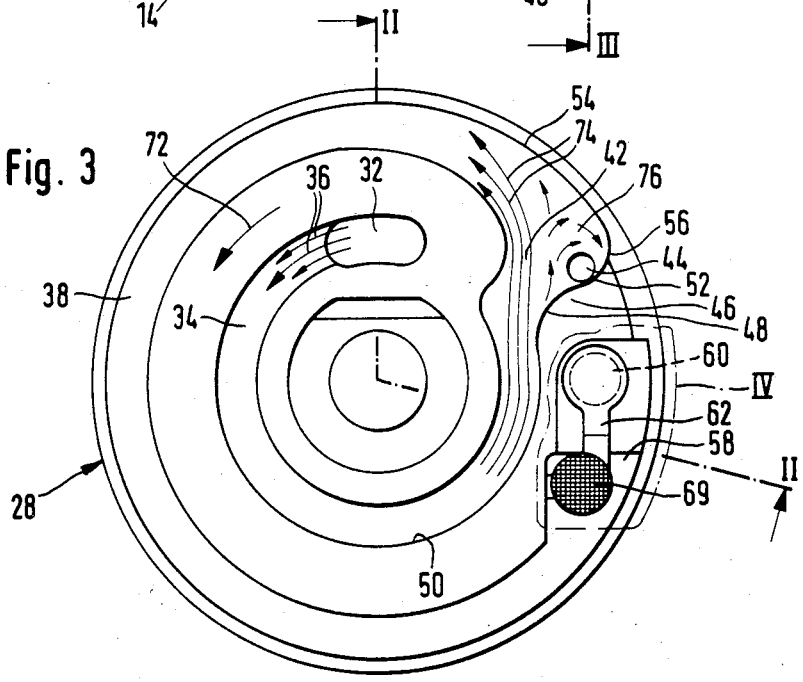
FIG. 3 showing a part of the feeding pump in a section taken along the line III—III in FIG. 2, on an enlarged scale.

As can be seen particularly from FIG. 3, the inner side passage 34 merges into an intermediate passage 42 which in turn opens into the outer ring or side passage 38. The pump rotor 22 is disc-shaped and has two end faces which extend transverse to the axis of rotation. Two feeding member rims 35 and 39 are formed on these end faces and both surround the axis of rotation of the rotor. The inner feeding member rim 35 is formed by a web which remains between a plurality of throughgoing openings extending parallel to the axis of rotation in the rotor 22. The diameter of the feeding member rim 35 is determined in correspondence with the diameter of the inner ring or side passage 34. The outer displacing member rim 39 is located in the marginal or peripheral region of the rotor 22 and is formed by a plurality of recesses, between which webs or vanes are retained. The outer diameter of the rotor 22 or the diameter of the outer displacing member rim 39 is determined in correspondence with the diameter of the outer ring or side passage.

Chamber walls lie opposite to both end faces of the rotor 22 and are formed on the intermediate wall 26 or the housing cover 28. The inner feeding member rim 35 together with the inner ring or side passage 34 form a first pressure stage of the feeding pump 20 which is arranged after a second pressure stage. The second pressure stage includes the outer feeding member rim 39 and the outer ring or side passage 38. The overflow of the flow medium from the first stage which is called a pre-feeding stage, to the second stage or end stage is performed through the intermediate passage 42.

The member 28 of the feeding pump 20 which forms the chamber wall is provided in the region of the intermediate passage 42 with a throughgoing opening 44. In this embodiment it is formed as a bore. The bore 44 extends through the member 28. As can be seen from FIG. 3, the cross-section of the intermediate channel 42 is greater than the cross-section of the side channels 34 and 38 so that the flow speed of the medium in the region of the intermediate passage 42 is reduced. The cross-section of the intermediate passage 42 diverges in the transition region from the inner side passage 34 and narrows toward the outer side passage 38. As can be further seen from FIG. 3, the throughgoing opening 44 extends behind a knee-shaped projection 46 extending in the intermediate passage 42. The knee-shaped projection 46 is curved outwardly on a longitudinal limit 48 of the intermediate passage 36 straight from the axis of rotation starting from an outer limit 50 of the inner side passage 34.

Relative limit 40 of the intermediate passage 42 then merges into a portion 52 which is at least approximately radial. The portion 52 in its outer extension corresponds to the course of an outer limit 54 of the outer side passage 38. The throughgoing opening 44 is located in the transition region between the radial portion 52 and a curvature 56 over which the longitudinal limit 48 of the intermediate passage 42 transits into the outer longitudinal limit 54 of the outer side passage 38. The bore 44 is located near the outer longitudinal limit of the intermediate passage 42.

Figure 4:
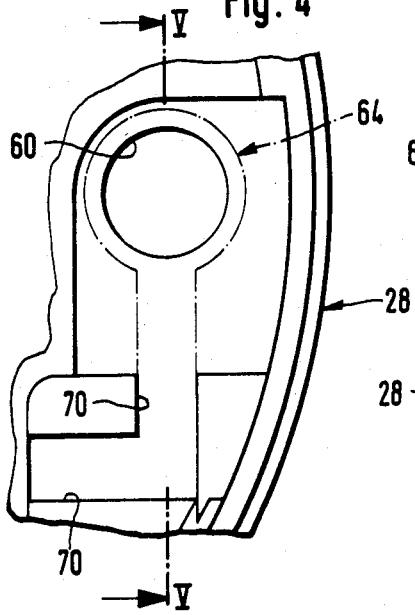
FIG. 4 is a view showing a fragment IV in FIG. 3 on an enlarged scale, wherein a closing flap is shown in dash-dot lines.
Figure 6:
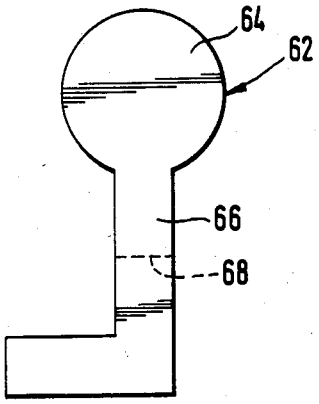
FIG. 6 is a front view of the closing cap shown in FIG. 4.
Figure 7:
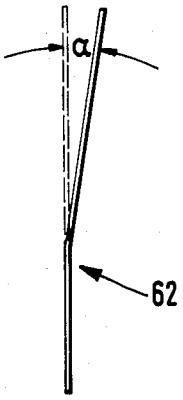
FIG. 7 is a side view of the closing cap shown in FIG. 6.

In an end region 58 of the outer side passage 38, a bore 60 which extends through the housing cover 28 is also arranged. This is particularly clear from FIGS. 3–5. The bore 60 lies substantially opposite to the pressure opening 40 of the intermediate wall 26. The bore 60 also forms a ventillating opening for the case when the pump is not in operation and filled with gas which can make considerably more difficult the feeding of fuel during subsequent operation of the feeding pump. For preventing the situation that in normal operation of the feeding aggregate a part of the fuel medium escapes through the bore 60, a closing flap 62 is associated with the bore 60 as shown in FIGS. 6 and 7.

The closing cap 62 has a sealing plate 64 with a diameter which is greater than the diameter of the bore 60. An angular lever 66 is formed on the sealing plate 64 and is bent in the region of a broken line 68 at an angle as shown in FIG. 7. An angular groove 70 in the housing cover 28 is associated with the angular of lever 68. The angular lever 68 can be inserted into the angular groove 70 so that the sealing plate 64 is located over the bore 60. The securing of the closing cap 62 on the housing cover 28 is performed by wedging over as identified with reference 69 in FIG. 3. The part of the edge of the angular groove 70 is deformed in a chip-free manner, so that the angular lever 66 and thereby the closing cap 62 are non-releasably connected with the housing cover 28.

Figure 5:
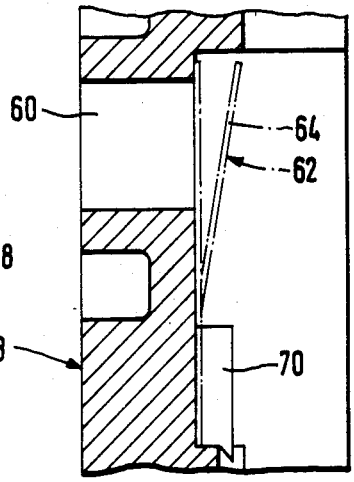
FIG. 5 is a view showing a section taken along the line V—V in FIG. 4.

Since the closing cap 62 is formed of a thin spring band steel the sealing plate 64 can move under overcoming of the spring force by the angle $\alpha$ and abut against the housing cover 28 as shown in FIG. 5. Thereby the bore 60 is closed. With respect to the course of the inner side passage 34, the outer side passage 38 and the intermediate passage 42, the chamber wall of the intermediate plate 26 is formed in correspondence with the housing cover 28. The intermediate plate 26, however, has no suction opening 32, no ventillating opening bore 44 and no ventillating opening 60 provided with a closing flap. Instead, it is provided with the pressure opening 40 which is not, however, available in the housing cover 28. The arrangement of the intermediate plate 26 relative to the housing cover 28 is so selected that the side passages 34 and 38 lie opposite to one another. The same is true with respect to the shape of the intermediate passage 42.

From a comparison of FIGS. 2 and 3 it can be seen that in FIG. 2 the suction opening 32 and the pressure opening 40 are arranged diametrically opposite to one another. This is obtained since the direction of sectioning in FIG. 2 is substantially curved in correspondence with the line II—II in FIG. 3. Showing of the closing flap 62 and the bore 60 in FIG. 2 is dispensed with for the sake of better visibility of the drawing.

The operation of the inventive feeding arrangement is described hereinbelow. In the beginning the feeding aggregate 14, particularly the feeding pump 20, is filled with gas. In operation the pump rotor 22 runs in direction of the arrow 72 (FIG. 3). Thereby it aspirates fuel via the pipe 12 or via the suction opening 32, from the supply tank 10, and gas accommodated in the pump is displaced simultaneously through the bore 60 out of the pump into the supply tank 10. This is possible since the closing flap 62 which acts as a valve flap does not abut against the face of the housing cover 28. The aspirated fuel is supplied into the inner side passage 34 in direction of the arrow 36, and particularly in the case of hot gasoline the flow medium in the aspirating region is gasified (cavitation) and leads to vapor bubbles. In the region of the intermediate passage 42 the fuel flows in direction of the arrow 74 into the outer side passage 38. By the above described cross-sectional increase an instantaneous stabilization (quieting) of the flow is obtained. The knee-shaped projection 46 extending into the intermediate passage 42 serves for a whirl-like deflection of a part of the fuel stream in accordance with the arrow 74 into a region 76 of the intermediate passage 42 located behind the projection 46. In this region the flow medium has only low dynamic pressure. Moreover, the static pressure of the flow medium increases in the region 76 and the vapor bubbles accommodated in the medium are reliably discharged through the ventillating bore 44. The fuel to be supplied enters only the outer side passage 38 in which it is transported further until it reaches the end region 58 of the outer side passage 38. As long as gas bubbles are transported in the region of the bore 60, the bore 60 remains open and the gas escapes through the bore 60 from the pump gas bubbles which exit the opening 44 reach directly the fuel tank 10. When however the liquid is transported in the region 58 of the outer side passage 38, a pressure difference takes place between the sealing plate 64 and the inner chamber of the fuel supply tank 10. This pressure difference is sufficient to overcome the spring force of the angular lever 66 and the sealing plate 64 abuts against the facing surface of the housing cover 28. The bore 60 is closed and the flow medium can now discharge only through the pressure opening 40 from the pump, and then it flows to the pressure conduit 16 and thereby to the internal combustion engine 18.

It will be understood that each of the elements described above, or two or more together, may also find a useful application in other types of constructions differing from the types described above.

While the invention has been illustrated and described as embodied in an arrangement for feeding fuel from supply tank to an internal combustion engine of a power vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for feeding fuel to an internal combustion engine of a power vehicle, comprising a supply tank; a feeding pump having a pump chamber, a rotor rotatable in said pump chamber, a suction side connected with said supply tank, a pressure side connectable with the internal combustion engine, said rotor having two end sides and being provided on at least one of said end sides with a rim-shaped feeding member having a first feeding member rim and a second feeding member rim which are arranged so that said first feeding member rim is surrounded by said second feeding member rim; means forming a wall of said chamber which is adjacent to said feeding member, said wall being provided with two substantially ring-shaped side passages which are located opposite to said feeding member rims and open toward the latter; a suction opening and a pressure opening, one of said side passages being an inner side passage and connected with said suction opening, while the other of said side passages being an outer side passage and being connected with said pressure opening, said inner side passage having an end portion located behind said suction opening, said outer side passage having a partial region located before said pressure opening as considered in a flow direction; means forming an intermediate passage in which said end portion of said inner side passage merges and which merges into said partial region of said outer side passage, said means forming said chamber wall including a member, said member in the region of said intermediate channel being provided with a throughgoing opening wherein said side passages having a predetermined cross-section, said intermediate passage having a cross-section which is greater than said cross-section of said side passages and which diverges in the flow direction starting from said inner side passage and narrows after said outer side passage, said feeding pump having a knee-shaped projection which extends into said intermediate passage, said throughgoing opening being arranged in the flow direction behind said projection.

2. An arrangement as defined in claim 1, wherein said member being provided with said suction opening, said throughgoing opening being arranged in said member.

3. An arrangement as defined in claim 1, wherein said chamber wall forming means includes a member which forms said chamber wall and is provided with a further throughgoing opening before said pressure opening as considered in the flow direction, said feeding pump further having a movable closing flap associated with said further throughgoing opening.

4. An arrangement as defined in claim 3, wherein said closing cap has a sealing plate and a lever connected with said sealing flap and mounted on said member.

5. An arrangement as defined in claim 4, wherein said lever is formed as an angular lever.

6. An arrangement as defined in claim 5, wherein said member has an angular groove, said angular lever of said closing cap being arranged in said angular groove of said member and connected with the same.

7. An arrangement as defined in claim 4, wherein said closing cap is formed of an elastic material, said further throughgoing opening having a mouth which faces toward said rotor, said sealing plate being unloaded and located at a distance over said mouth of said further throughgoing opening.

* * * * *